US009715803B2

(12) United States Patent
Strassburger

(10) Patent No.: US 9,715,803 B2
(45) Date of Patent: Jul. 25, 2017

(54) SECURITY TAG WITH SHRINK TUBE

(71) Applicant: B&G Plastics, Inc., Union, NJ (US)

(72) Inventor: Jake Strassburger, South Plainfield, NJ (US)

(73) Assignee: B&G PLastics, Inc., Union, NJ (US)

( * ) Notice: Subject to any disclaimer, the term of this patent is extended or adjusted under 35 U.S.C. 154(b) by 259 days.

(21) Appl. No.: 14/532,146

(22) Filed: Nov. 4, 2014

(65) Prior Publication Data

US 2015/0123799 A1 May 7, 2015

Related U.S. Application Data

(60) Provisional application No. 61/899,448, filed on Nov. 4, 2013.

(51) Int. Cl.
*G08B 13/24* (2006.01)

(52) U.S. Cl.
CPC ..... *G08B 13/2434* (2013.01)

(58) Field of Classification Search
CPC ..... G08B 13/2434
See application file for complete search history.

(56) References Cited

U.S. PATENT DOCUMENTS

| | | | | |
|---|---|---|---|---|
| 5,537,765 | A | 7/1996 | Liebman et al. | |
| 5,969,613 | A * | 10/1999 | Yeager | E05B 73/0017 340/568.1 |
| 5,988,462 | A | 11/1999 | Kolton | |
| 6,145,167 | A | 11/2000 | Brentini | |
| 6,317,046 | B1 | 11/2001 | Fresnel et al. | |
| 6,330,758 | B1 * | 12/2001 | Feibelman | G02C 11/00 351/158 |
| 6,518,888 | B1 | 2/2003 | Kolton et al. | |
| 7,804,408 | B2 | 9/2010 | Kolton et al. | |
| 8,601,732 | B2 | 12/2013 | Kolton et al. | |
| 2007/0273535 | A1 | 11/2007 | Kolton et al. | |
| 2008/0272917 | A1 | 11/2008 | Feibelman et al. | |
| 2010/0277323 | A1 * | 11/2010 | Feibelman | G08B 13/2402 340/572.8 |
| 2012/0017479 | A1 * | 1/2012 | Kolton | G09F 3/0297 40/638 |

* cited by examiner

*Primary Examiner* — James Yang
(74) *Attorney, Agent, or Firm* — Hoffman & Baron, LLP

(57) ABSTRACT

A tag assembly for securing a tag to a projection on merchandise, such as a temple arm on a pair of eyeglasses. The tag assembly includes a tag having a tag body and cover to hold a security device and a shrink tube. The tag body is placed within the shrink tube and the tube is then slid over the projection of the merchandise. The tube is then subjected to heat to shrink the tube around the projection on the merchandise to secure the tag assembly thereon. The cover is then moved from the open, installation position to the closed position.

19 Claims, 7 Drawing Sheets

SECURITY TAG WITH SHRINK TUBE

CROSS-REFERENCE TO RELATED APPLICATION

This application claims priority to U.S. Patent Application Ser. No. 61/899,448 filed on Nov. 4, 2013, the disclosure of which is incorporated herein by reference.

FIELD OF THE INVENTION

The present invention relates generally to merchandise security tags, and particularly to an electronic article surveillance tag which can be attached to a projection on merchandise, such as a temple arm on a pair of eyeglasses.

BACKGROUND OF THE INVENTION

Theft of merchandise from stores costs retailers millions of dollars of losses each year. The theft of small articles such as eyeglasses from retail stores is a particularly common problem. These items are typically displayed for sale on racks or display cases which allow the consumer to try them on. Eyeglasses are particularly easy for a thief to conceal and walk out of the store without paying. A variety of different tags have been used to attach electronic article surveillance (EAS) tags to such goods. Such tags must be easy to attach and remove from the eyeglasses without damaging them. Also, these tags must be cost efficient for the retailer.

The security tag should also be designed so as not to interfere with the consumers ability to try on the eyeglasses to determine whether they wish to purchase them. Typically, consumers will try on several pairs of glasses before making a purchase decision. Thus, the security tag should be designed so that the glasses may be easily removed from the display and put back in place by the consumer without damaging the goods or the security tag.

Accordingly, there is a need for a security tag which is inexpensive to manufacture and simple to secure to a pair of eyeglasses without interfering with the consumer's ability to remove the glasses from the display, try them on, and put them back in the display.

SUMMARY OF THE INVENTION

In accordance with the present invention, a security tag is provided which can be secured to a prong, projection, or finger on merchandise, such as a temple arm on a pair of eyeglasses. The tag assembly includes a body having a top and bottom surface, the body including a latch receiver at one end thereof. At the other end of the body is a tag cover coupled to the body via a living hinge. The tag cover includes a latch at the end opposite the living hinge for engagement with the latch receiver in the closed position. The cover includes an inner surface upon which a security device may be mounted. The tag assembly further includes a shrink tube made from a material which shrinks when subjected to heat. To install the tag assembly, the tag body is inserted into the shrink tube. The tube and tag assembly is then slide over the merchandise projection, such as the temple arm of the eyeglasses. Upon subjecting the shrink tube to heat, the tube shrinks around the tag and temple arm to secure the tag body to the temple arm. The cover is then moved from the open position to a closed position such that the latch is coupled to the latch receiver. Once the shrink tube is heated, the tag is secured to the temple arm and can only be removed by cutting the shrink tube. Thus, the present invention discourages theft of objects to which the tag is mounted, such as eyeglasses, and allows the consumer the ability to remove the tag from the purchased merchandise with the use of a pair of scissors by cutting off the shrink tube.

In one embodiment of the present invention, the top surface of the tag body includes an elongated longitudinal rib thereon. The rib spaces the shrunken tube away from the body to permit a cutting tool, such as scissors to be inserted into the tube for removal from the merchandise. A bottom surface of the tag body preferably includes an elastomeric friction pad mounted thereto. The pad serves a dual purpose of protecting the merchandise, such as the eyeglass temple arm, from damage by the tag assembly and also provides a pad having a high coefficient of friction to prevent a consumer from sliding the tag off the merchandise. The pad may be adhesively bonded to the bottom surface of the tag body. The pad may be made from any suitable material such as rubber or plastic.

The shrink tube is formed from biaxially oriented plastic material, such as polypropylene, polyvinyl chloride (PVC) or polyethylene, and is designed to shrink when heat is applied. The tube may be transparent or may be provided in a color either matching the tag or a color contrasting the tag color.

Other features and advantages of the invention will become apparent from the following detailed description, which, when considered in connection with the figures herein, discloses a preferred embodiment of the invention.

BRIEF DESCRIPTION OF THE DRAWINGS

Referring now to the drawings that form a part of the original disclosure.

DETAILED DESCRIPTION

The present invention is directed to a security tag assembly adapted to be mounted on a prong, projection or finger on merchandise, such as a temple arm on a pair of eyeglasses. The tag assembly includes a tag body having a tag cover hingedly attached thereto. The tag cover is movable between an open, installation position and a closed, installed position. The tag body is secured to the merchandise using a shrink tube, which, when subjected to heat shrinks around the tag body and a projection on the merchandise.

Figure 1:
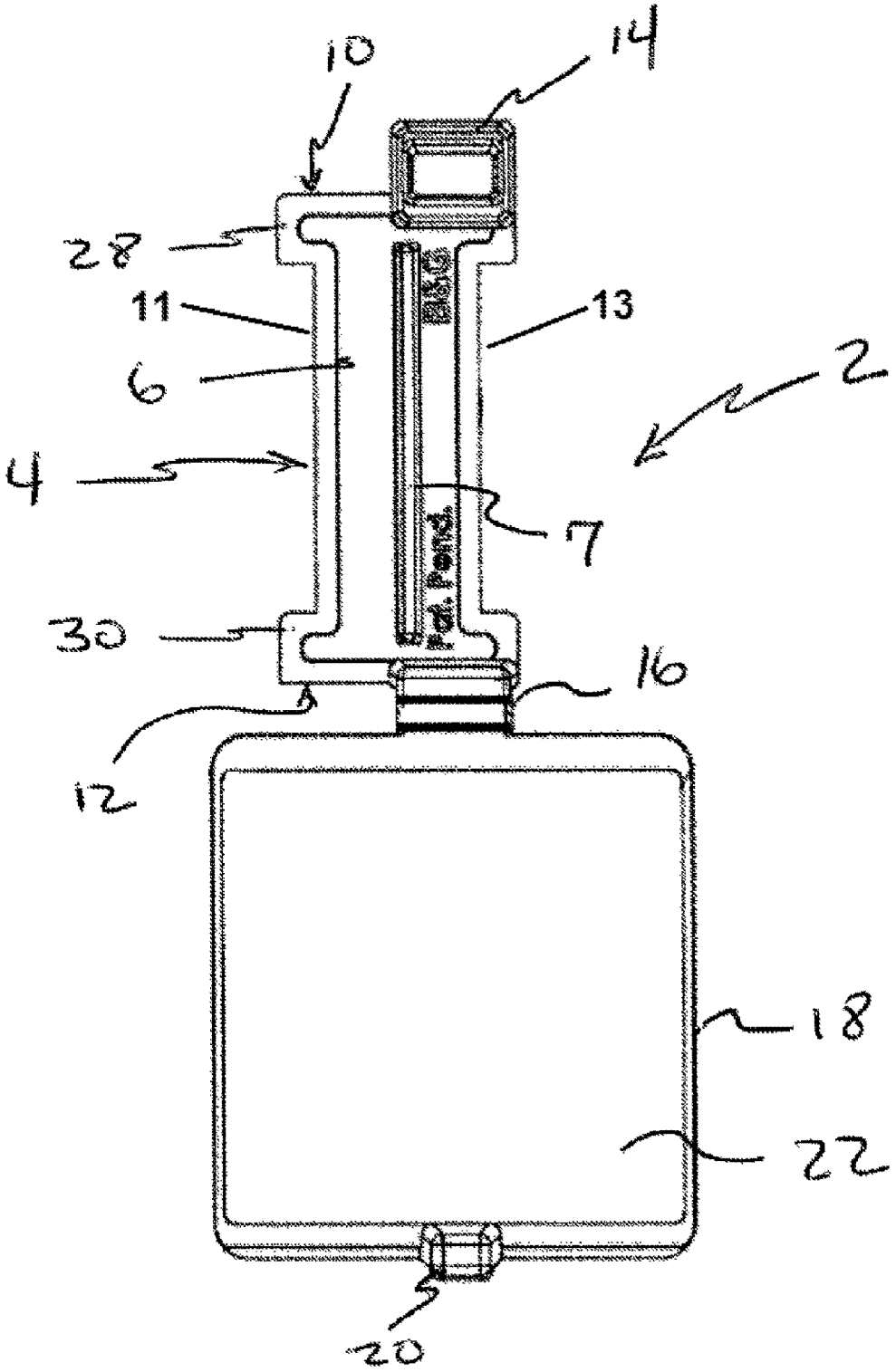
FIG. 1 is a top view of the security tag illustrated in an open position and formed in accordance with the present invention.
Figure 2:
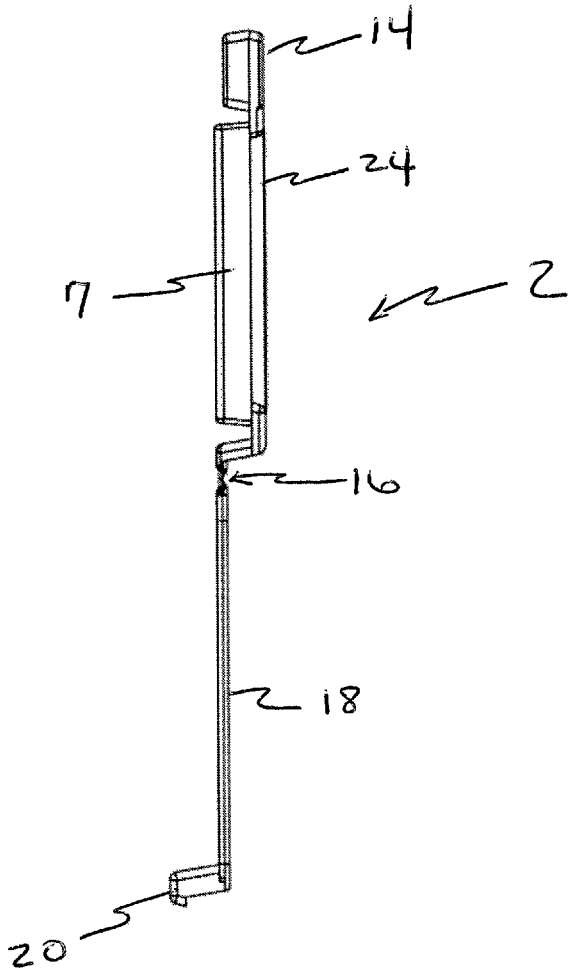
FIG. 2 is a side elevation view of the security tag illustrated in FIG. 1.
Figure 3:
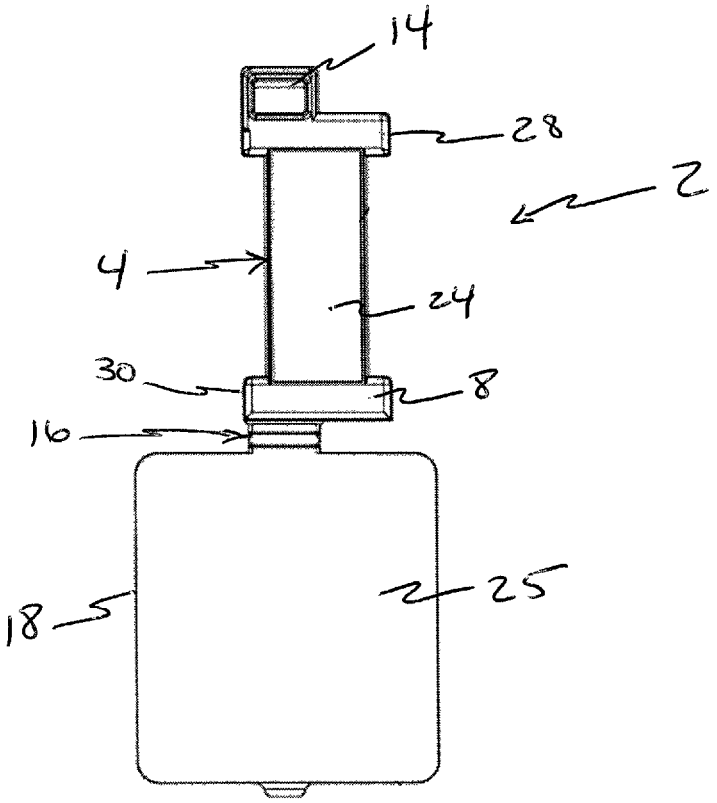
FIG. 3 is a bottom view of the security tag illustrated in FIG. 1.

Referring to FIGS. 1-3, the tag 2 includes a tag body 4. The tag body has a top surface 6 and a bottom surface 8. The top surface 6 of the tag body 4 preferably includes a raised, elongated longitudinal rib 7, which is equidistant from a first side 11 and a second side 13 of the tag body 4 and which extends from an upper flange 28 on a first end 10 to a lower flange 30 on a second end 12 of the body. The raised rib 7 functions to create a space or gap which allows a cutting tool to be inserted for removal of the tag assembly, which will be described in greater detail below.

Figure 4:
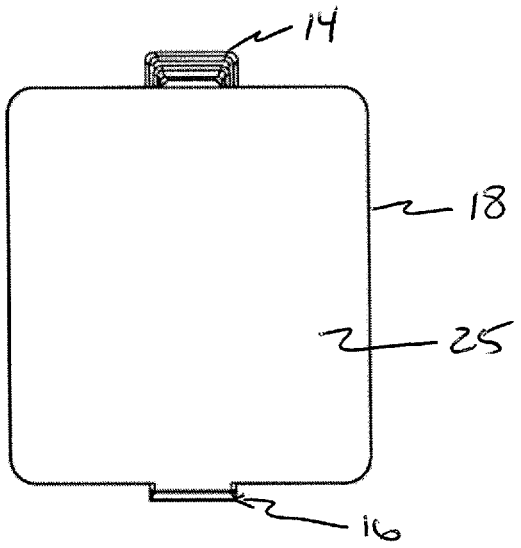
FIG. 4 is a top view of the security tag illustrated in a closed position and formed in accordance with the present invention.
Figure 5:
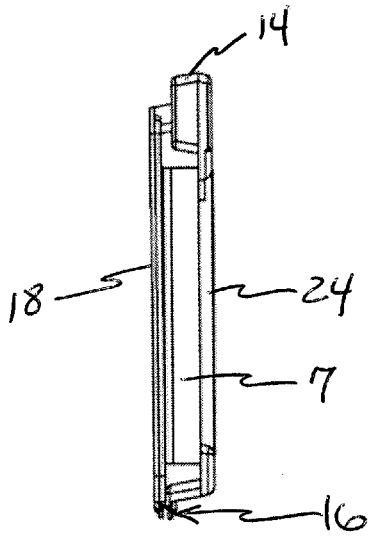
FIG. 5 is a side elevation view of the security tag illustrated in FIG. 4.
Figure 6:
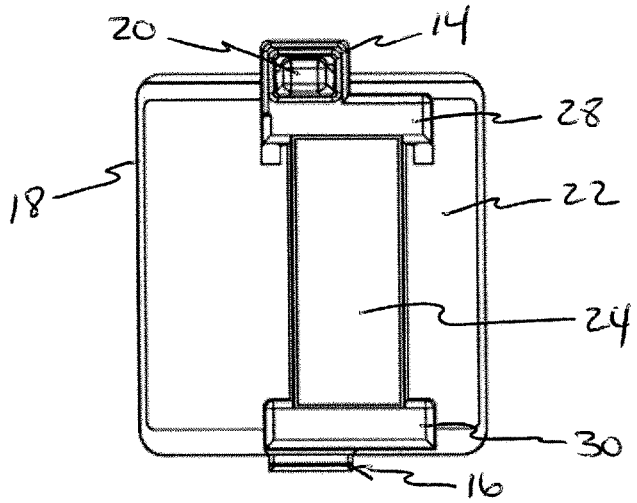
FIG. 6 is a bottom view of the security tag illustrated in FIG. 4.

The first end of the tag body includes a latch receiver 14. The second end of the tag body includes a living hinge 16 coupled to a tag cover 18. The end of the tag cover opposite the living hinge includes a latch 20. The tag cover 18 is movable between an open, installation position as shown in FIGS. 1-3 to a closed, installed position as shown in FIGS. 4-6. The cover 18 includes a mounting surface for receiving a security device 22. The security device can be any known means for alerting a retail store that merchandise is being taken from the store without payment. One example is what is commonly referred to as an electronic article surveillance (EAS) device. The security device 22 is mounted to the cover and the cover can be moved to the closed position so that the latch 20 and latch receiver 14 cooperate to lock the cover to the tag body to prevent removal of the security device by a potential thief.

Referring to FIGS. 2 and 3, the tag 2 also includes a bottom surface 8 having an elastomeric pad 24 mounted thereon. The elastomeric pad is preferably formed from a material which has a high co-efficient of friction, such as rubber. When installed, the elastomeric pad 24 contacts the merchandise, such as the temple arm of the eyeglasses. The elastomeric pad 24 serves two functions. First, it provides a non-abrasive surface for the tag assembly to be mounted to the merchandise so as not to damage or scratch the merchandise. Second, the elastomeric pad 24 prevents a consumer from sliding the tag assembly off the merchandise. The elastomeric pad 24 may be mounted to the bottom surface of the tag body using any suitable adhesive.

Referring to FIG. 3, the outer surface of the tag cover 25 provides a surface for placement of stickers, bar codes, logos or the like. The cover may include artwork stamped directly onto the cover or a sticker may be applied to the cover. The sticker may include such information as a manufacturer's logo, style information and/or a bar code.

Referring to FIGS. 4-6, the tag 2 is illustrated in the closed or installed position wherein the cover 25 has been rotated about the living hinge and the latch 20 has been secured into the latch receiver 14. In the closed position, the tag has a relatively small profile.

Figure 7:
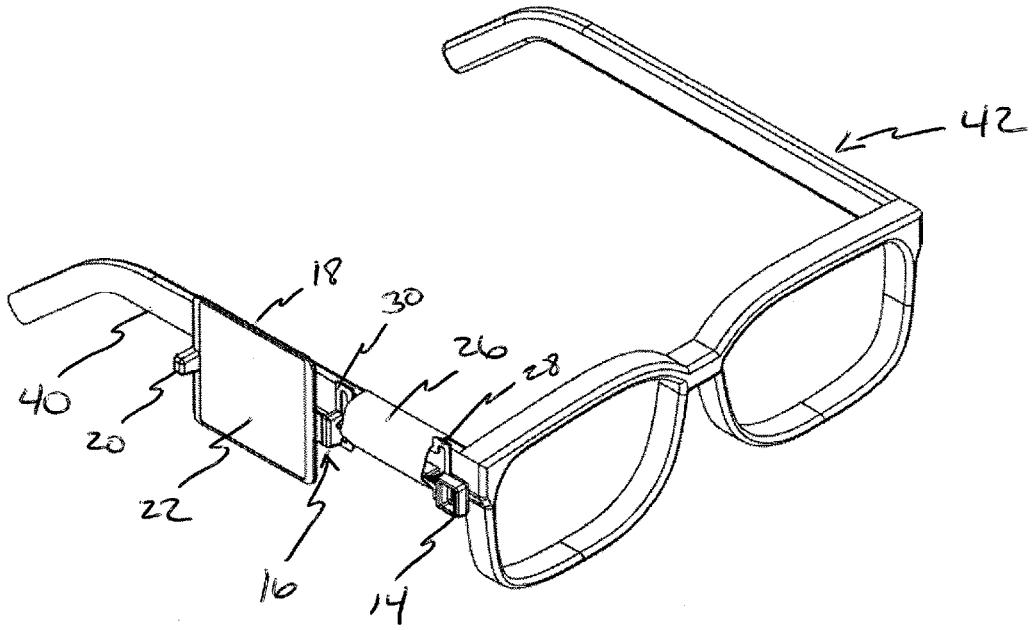
FIG. 7 is a perspective view of a pair of eyeglasses having the tag assembly of the present invention in an open position mounted on a temple arm of the eyeglasses.

As shown in FIG. 7, the tag assembly 2 further includes a shrink tube 26 for securing the tag to the merchandise, such as the temple arm 40 of the eyeglasses 42. The shrink tube 26 is preferably substantially tubular in shape, although other configurations such as a capital "D" shape having one flat side would also work equally as well. The shrink tube is made from a material, which when subjected to heat, shrinks in the radial direction. Such materials are well known and have been in use for many years. Preferably, the shrink tube is made of a transparent plastic which is biaxially oriented. Polyethylene is the preferred plastic material for the shrink tube; however, other heat shrinkable plastics, including but not limited to polypropylene and polyvinyl chloride, may also be used. The shrink tube is dimensioned to have an opening large enough to accommodate the tag body and a projection, such as an eyeglass temple arm, yet shrink to a size which secures the tag body to the projection or temple arm.

By way of example, to install the tag assembly 2 on the eyeglass temple arm 40, the shrink tube 26 is slid over the end of the temple arm 40 to a location preferably near the temple arm hinge. The tag body is then slid into the shrink tube so that the elastomeric pad 24 mounted on the bottom surface of the tag body rests against the outer surface of the temple arm. As shown in FIGS. 1 and 3, the tag body 4 preferably includes an upper and lower flange 28, 30, respectively, at the first and second ends of the tag body, creating a reduced width in the tag body between the upper and lower flanges. The shrink tube 26 preferably has a longitudinal dimension which fits between the upper 28 and lower 30 flanges to hold the tube in place during the heating process. Once the tag body has been aligned in the shrink tube adjacent the temple arm, the shrink tube is subjected to heat and shrinks radially to force the elastomeric pad against the temple arm and secure the tag body to the temple arm as shown in FIG. 7.

Figure 8:
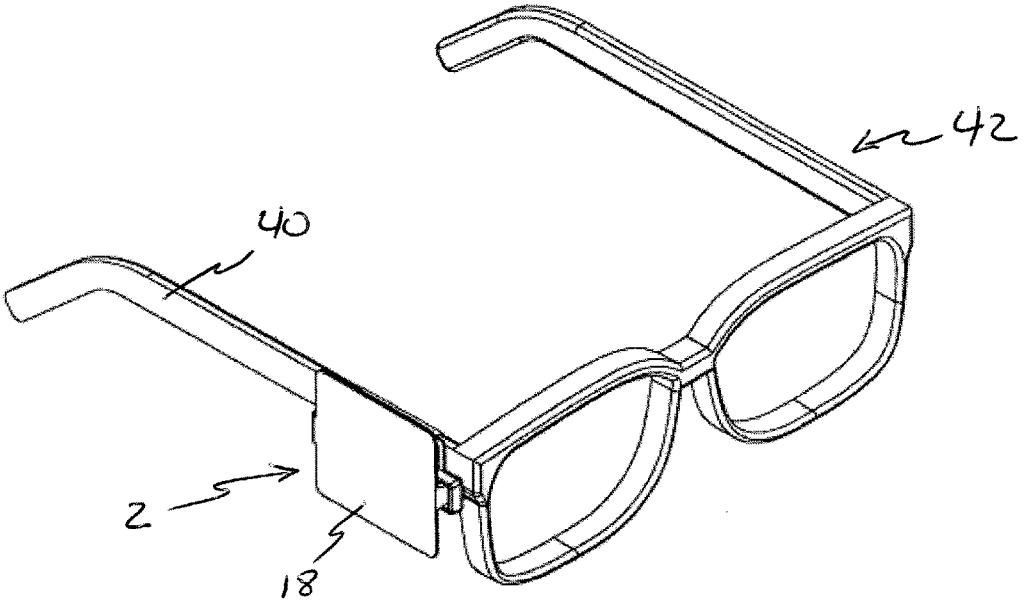
FIG. 8 is a perspective view of a pair of eyeglasses having the tag assembly of the present invention in a closed position mounted on a temple arm of the eyeglasses.
Figure 9:
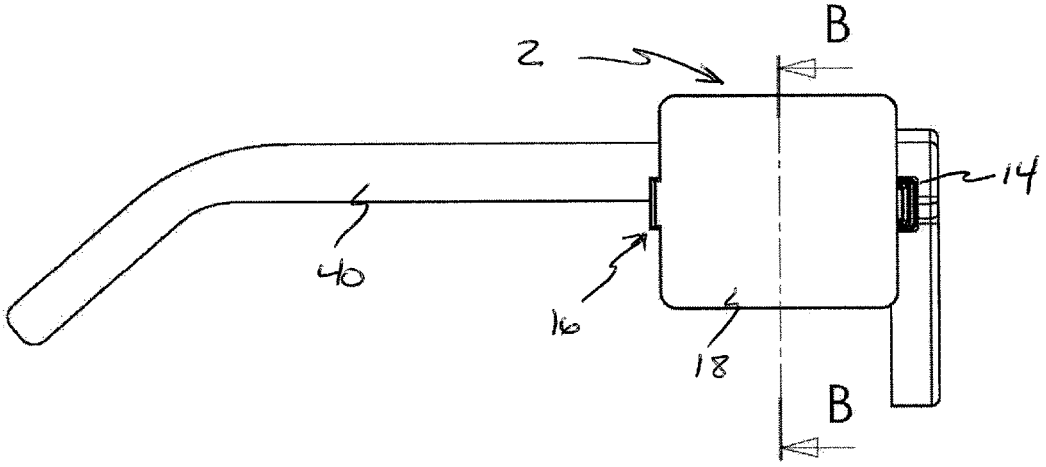
FIG. 9 is a side view of the tag assembly mounted on the temple arm of the eyeglasses as illustrated in FIG. 8.
Figure 10:
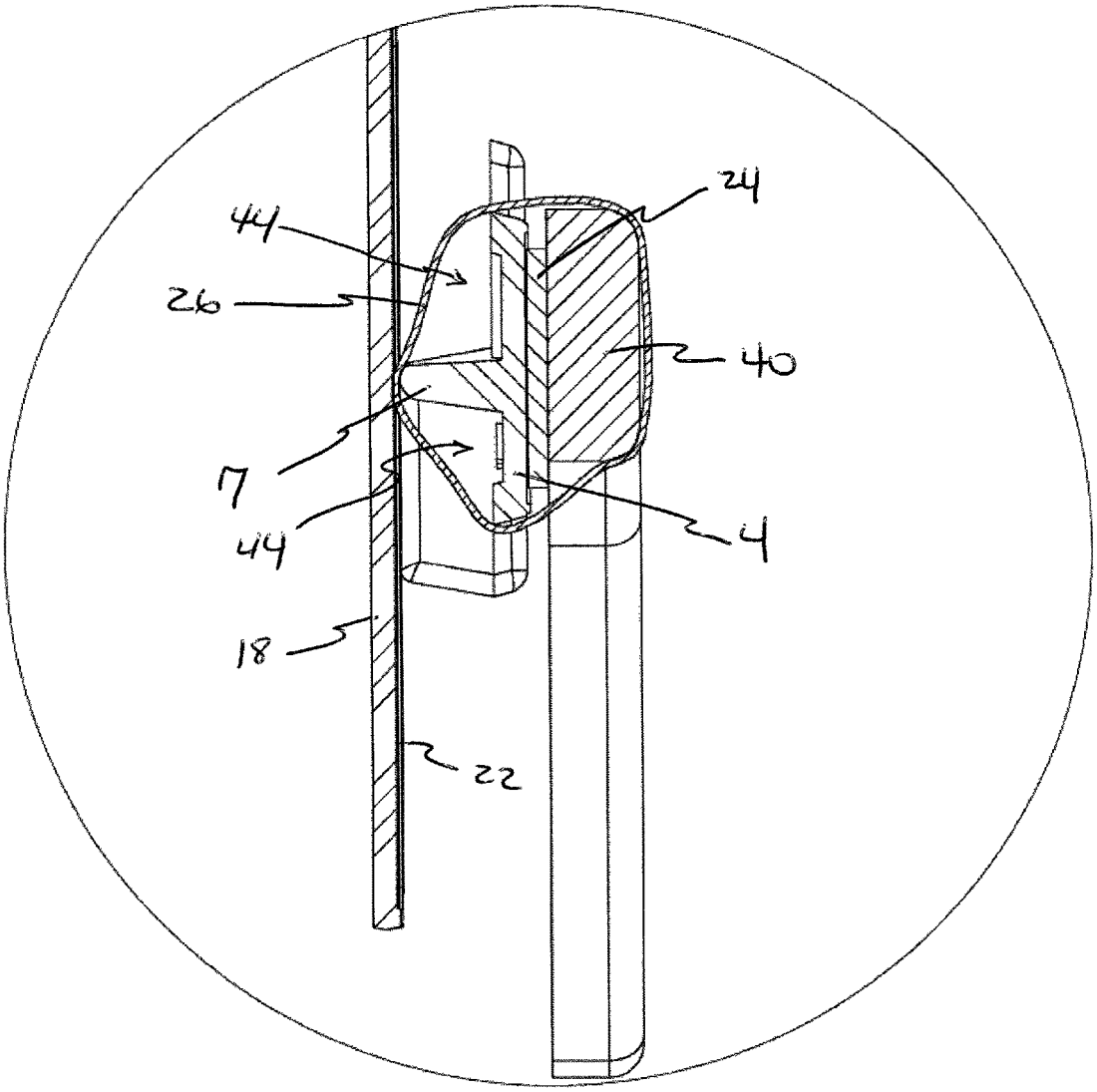
FIG. 10 is a cutaway view of the tag assembly mounted on the temple arm of the eyeglass through line B-B in FIG. 9.

Once the tag body has been secured to the temple arm by the shrink tube, the cover 18 may be rotated from the open position shown in FIG. 7 to the closed or locked position shown in FIGS. 8 and 9. FIG. 10 is a cross-sectional view through line B-B of FIG. 9. As can be seen in FIG. 10, the shrink tube 26 shrinks around the temple arm 40 and tag body 4 forcing the elastomeric pad 24 against an outer surface of the temple arm to secure the tag assembly thereto. The elongated raised rib 7 on the top surface of the tag body serves the function of creating a space or gap 44 into which a cutting tool, such as a pair of scissors, can be inserted to cut the shrink tube so that the security tag may be removed from the merchandise.

As will be appreciated by those skilled in the art, while the inventive tag assembly has been described for use on a temple arm of eyeglasses, the tag assembly may be installed on any merchandise which includes an elongated prong, finger or projection onto which the shrink tube may be slide over. One such example may be a tool, such as a screwdriver in which the tag assembly is mounted on the screwdriver shaft. Accordingly, the invention is directed to the tag assembly which can be mounted on a variety of different types of merchandise, even though not explicitly disclosed herein.

Furthermore, although the invention is described as being a tag assembly having a security device, it will be appreciated by those skilled in the art that the tag may not include a security device. The tag may be used to attach information to the merchandise such as graphics, brand names, bar codes, style numbers, prices, or other such information.

Thus, while there have been described the preferred embodiments of the present invention, those skilled in the art will realize that other embodiments can be made without departing from the spirit of the invention, and it is intended to include all such further modifications and changes as coming within the scope of the claims set forth herein.

What is claimed is:

1. A tag assembly for securing a tag to merchandise, the tag assembly comprising:

a tag comprising a body having a first end, a second end, a first side, a second side, a longitudinal axis, a top surface, a bottom surface, and a raised elongated rib on the top surface extending along the longitudinal axis continuously between an upper flange on the first end and a lower flange on the second end, the first end including a latch receiver and the second end including a living hinge coupled to a tag cover, the tag cover including a latch on an end opposite the living hinge, the cover further including an inner surface upon which a security device is mounted, wherein the longitudinal axis is parallel to and equidistant from the first and second sides; and a shrink tube made from a material which shrinks when subjected to heat, the shrink tube being fitted over the body and adapted to receive a projection extending from the merchandise such that upon subjecting said shrink tube to heat, the tube shrinks to secure the body to the merchandise projection, and further wherein the cover is moved from a first open position to a second closed position such that the latch is coupled to the latch receiver.

2. A tag assembly as defined in claim 1, wherein the merchandise is a pair of eyeglasses and the projection is a temple arm.

3. A tag assembly as defined by claim 1, wherein the rib spaces the shrink tube away from the body to permit a cutting tool to be inserted into the tube for removal of the tag assembly from the merchandise.

4. A tag assembly as defined by claim 1, wherein the bottom surface of the body includes an elastomeric friction pad mounted thereto.

5. A tag assembly as defined by claim 4, wherein the elastomeric friction pad is adhesively bonded to the bottom surface of the body.

6. A tag assembly as defined by claim 4, wherein an outer surface of the elastomeric friction pad contacts the merchandise.

7. A tag assembly as defined by claim 4, wherein the elastomeric friction pad is made of rubber.

8. A tag assembly as defined by claim 1, wherein the shrink tube comprises transparent plastic.

9. A tag assembly as defined by claim 1, wherein the shrink tube comprises a biaxially oriented plastic material.

10. A tag assembly as defined by claim 1, wherein the shrink tube comprises polyethylene, polypropylene or polyvinyl chloride.

11. A tag assembly as defined by claim 1, wherein the body includes upper and lower flanges and further wherein the shrink tube is positioned between the upper and lower flanges.

12. A tag assembly as defined by claim 1, wherein the security device comprises an electronic surveillance tag.

13. A tag assembly for securing a tag to merchandise comprising:

a tag comprising a body hinged to a cover, the body having a latch receiver, a first end, a second end, a first side, a second side, a longitudinal axis, a top surface, and a raised elongated rib on the top surface extending along the longitudinal axis continuously between an upper flange on the first end and a lower flange on the second end and the cover having a latch, wherein the body and the cover are movable between an open position and a closed position in which the latch is coupled to the latch receiver, and wherein the longitudinal axis is parallel to and equidistant from the first and second sides; and a tube made from a material which shrinks when subjected to heat, the tube being fitted over said body and adapted to receive a projection on the merchandise such that upon subjecting the tube to heat, the tube shrinks around said body, and wherein in the closed position, a portion of the shrink tube is sandwiched between the body and the cover.

14. A tag assembly as defined by claim 13, wherein the merchandise is a pair of eyeglasses and the projection is a temple arm.

15. A tag assembly as defined by claim 13, wherein the body includes upper and lower flanges and wherein the tube is positioned between the upper and lower flanges prior to and after the tube shrinks.

16. A tag assembly as defined by claim 13, wherein the body includes a security device mounted thereon.

17. A tag assembly as defined by claim 16, wherein the security device is mounted between the body and the cover in the closed position.

18. A tag assembly as defined by claim 16, wherein the security device comprises an electronic surveillance tag.

19. In combination, a pair of eyeglasses having a temple arm attached to a lens frame and an apparatus for attaching a security device to the eyeglasses, the apparatus comprising:

a tag comprising a body hinged to a cover, the body having a latch receiver, a first end, a second end, a first side, a second side, a longitudinal axis, a top surface, and a raised elongated rib on the top surface extending along the longitudinal axis continuously between an upper flange on the first end and a lower flange on the second end and the cover having a latch, wherein the body and the cover are movable between an open position and a closed position in which the latch is coupled to the latch receiver, and wherein the longitudinal axis is parallel to and equidistant from the first and second sides; and a tube made from a material which shrinks when subjected to heat, the tube being fitted over said body and adapted to receive a projection on the merchandise such that upon subjecting the tube to heat, the tube shrinks around said body, and wherein in the closed position, a portion of the shrink tube is sandwiched between the body and the cover.

* * * * *